US007237544B2

(12) United States Patent
Jones

(10) Patent No.: US 7,237,544 B2
(45) Date of Patent: Jul. 3, 2007

(54) PNEUMATIC PAINTBALL GUN AND COMPONENTS

(75) Inventor: Danial S. Jones, Ligonier, PA (US)

(73) Assignee: Smart Parts, Inc., Latrobe, PA (US)

( * ) Notice: Subject to any disclaimer, the term of this patent is extended or adjusted under 35 U.S.C. 154(b) by 106 days.

(21) Appl. No.: 10/753,215

(22) Filed: Dec. 22, 2003

(65) Prior Publication Data

US 2005/0133014 A1 Jun. 23, 2005

(51) Int. Cl.
*F41B 11/00* (2006.01)

(52) U.S. Cl. ..... 124/73

(58) Field of Classification Search ..... 124/71–77
See application file for complete search history.

(56) References Cited

U.S. PATENT DOCUMENTS

| | | | | |
|---|---|---|---|---|
| 2,304,320 | A | 12/1942 | Tratsch | 124/77 |
| 2,554,116 | A | 5/1951 | Monner | 124/11 |
| 2,568,432 | A | 9/1951 | Cook | 124/77 |
| 2,594,240 | A | 4/1952 | Wells | 124/13 |
| 2,634,717 | A | 4/1953 | Junkin | 124/11 |
| 2,834,332 | A | 5/1958 | Guthrie | 124/77 |
| 2,845,055 | A | 7/1958 | Collins et al. | 124/32 |
| 2,845,805 | A | 7/1958 | Collins et al. | 124/77 |
| 3,089,476 | A | 5/1963 | Wolverton | 124/77 |
| 3,192,915 | A | 7/1965 | Norris et al. | 124/77 |
| 3,662,729 | A | 5/1972 | Henderson | 124/73 |
| 3,695,246 | A | 10/1972 | Filippi et al. | 124/77 |
| 3,921,980 | A | 11/1975 | Artzer | 124/77 |
| 4,009,536 | A | 3/1977 | Wolff | 42/84 |
| 4,094,294 | A | 6/1978 | Speer | 124/56 |
| 4,269,163 | A | 5/1981 | Feith | 124/77 |
| 4,362,145 | A | 12/1982 | Stelcher | 124/32 |
| 4,730,407 | A | 3/1988 | DeCarlo | 42/84 |
| 4,770,153 | A | 9/1988 | Edelman | 124/77 |

(Continued)

FOREIGN PATENT DOCUMENTS

EP 94026535 2/1993

(Continued)

OTHER PUBLICATIONS

Matrix-Main Body Assembly & Parts Listing at http://www.directpaintball.com/pics/diablomatrix/matrixparts.gif. 3 pages.

(Continued)

*Primary Examiner*—Troy Chambers
(74) *Attorney, Agent, or Firm*—Marger Johnson & McCollom, P.C.

(57) ABSTRACT

An electro-pneumatic paintball gun preferably comprises a bolt assembly and a firing valve assembly that can be readily removed from the paintball gun. A bolt assembly preferably comprises a bolt sleeve. The bolt assembly is preferably removed by turning the bolt sleeve a predetermined rotational distance and then retracting the bolt assembly from a rearward opening in the paintball gun. The firing assembly preferably comprises a pneumatic piston rod and cylinder and a firing valve. A firing mass is preferably arranged on a rearward end of the piston rod. The forward end of the piston rod preferably engages the firing valve. The firing mass can include a groove for receiving a bolt linkage from the bolt assembly.

17 Claims, 6 Drawing Sheets

U.S. PATENT DOCUMENTS

| | | | | |
|---|---|---|---|---|
| 4,819,609 | A | 4/1989 | Tippmann | 124/72 |
| 4,899,717 | A | 2/1990 | Rutten et al. | 124/32 |
| 4,936,282 | A | 6/1990 | Dobbins et al. | 124/74 |
| 5,063,905 | A | 11/1991 | Farrell | 124/72 |
| 5,083,392 | A | 1/1992 | Bookstaber | 42/84 |
| 5,228,427 | A | 7/1993 | Gardner, Jr. | 124/71 |
| 5,261,384 | A | 11/1993 | Hu | 124/66 |
| 5,280,778 | A | 1/1994 | Kotsiopoulos | 124/73 |
| 5,285,765 | A | 2/1994 | Lee | 124/50 |
| 5,333,594 | A | 8/1994 | Robinson | 124/73 |
| 5,337,726 | A | 8/1994 | Wood | 124/61 |
| 5,349,938 | A | 9/1994 | Farrell | 124/73 |
| 5,383,442 | A | 1/1995 | Tippmann | 124/76 |
| 5,413,083 | A | 5/1995 | Jones | 124/32 |
| 5,462,042 | A | 10/1995 | Greenwell | 124/76 |
| 5,497,758 | A * | 3/1996 | Dobbins et al. | 124/73 |
| 5,515,838 | A | 5/1996 | Anderson | 124/76 |
| 5,613,483 | A | 3/1997 | Lukas et al. | 124/73 |
| 5,878,736 | A | 3/1999 | Lotuaco, III | 124/71 |
| 5,881,707 | A | 3/1999 | Gardner, Jr. | 124/77 |
| 5,967,133 | A | 10/1999 | Gardner, Jr. | 124/77 |
| 6,003,504 | A | 12/1999 | Rice et al. | 124/73 |
| 6,035,843 | A | 3/2000 | Smith et al. | 124/77 |
| 6,138,656 | A * | 10/2000 | Rice et al. | 124/73 |
| 6,142,136 | A * | 11/2000 | Velasco | 124/71 |
| 6,343,599 | B1 | 2/2002 | Perrone | 124/33 |
| 6,349,711 | B1 | 2/2002 | Perry et al. | 124/73 |
| 6,474,326 | B1 | 11/2002 | Smith et al. | 124/77 |
| 6,516,791 | B2 | 2/2003 | Perrone | 124/77 |
| 6,520,172 | B2 | 2/2003 | Perrone | 124/74 |
| 6,553,983 | B1 * | 4/2003 | Li | 124/73 |
| 6,637,421 | B2 | 10/2003 | Smith et al. | 124/77 |
| 6,644,295 | B2 | 11/2003 | Jones | 124/77 |
| 6,644,296 | B2 | 11/2003 | Gardner, Jr. | 124/77 |
| 6,820,606 | B1 * | 11/2004 | Duffey | 124/31 |
| 6,868,846 | B2 * | 3/2005 | Jzn | 124/74 |
| 6,973,748 | B2 * | 12/2005 | Rice | 42/69.01 |
| 2002/0096164 | A1 | 7/2002 | Perrone | 124/77 |
| 2002/0170551 | A1 | 11/2002 | Kotsiopoulos et al. | 124/54 |
| 2003/0079731 | A1 * | 5/2003 | Dobbins | 124/76 |
| 2005/0109329 | A1 * | 5/2005 | Janavicius | 124/61 |

FOREIGN PATENT DOCUMENTS

| | | |
|---|---|---|
| GB | 2146416 | 4/1985 |
| GB | 2313655 | 12/1997 |
| WO | WO 97/26498 | 6/1997 |

OTHER PUBLICATIONS

Techno Paintball- information reviews articles forum auction and chat at http://www.technopaintball.com/matrixreview.htm 2 pages.

Bob Long, "Bob Long Intimidator 2002 Dragon Ripper," Aug. 2002, 28 pages.

* cited by examiner

PNEUMATIC PAINTBALL GUN AND COMPONENTS

BACKGROUND OF THE INVENTION

This application relates generally to paintball guns (or "markers"). The inventive principles disclosed in this application primarily relate to electro-pneumatic paintball guns and components for electro-pneumatic paintball guns, including, among other things, bolt and firing assemblies.

It is common for pneumatic paintball guns, including electro-pneumatic paintball guns, to use firing assemblies and bolt assemblies. For instance, in U.S. Pat. No. 6,349,711 (incorporated herein by reference) the firing assembly includes a firing valve actuated by a separate pneumatic ram assembly, and a bolt coupled to the pneumatic ram assembly through an externally-protruding removable bolt pin. To remove the bolt for maintenance or cleaning, the bolt pin is removed from the gun and the bolt is then allowed to slide out. This bolt pin is a separate part that must be kept track of during cleaning and maintenance.

To avoid loss of the bolt pin, some paintball gun manufacturers have provided bolt pins that do not completely separate from the bolt. These bolt pins typically release from the pneumatic ram assembly by an upward movement of the bolt pin, and can then be slid out of the paintball gun along with the bolt via a channel formed in the paintball gun body. These solutions still maintain an externally protruding bolt pin. Another approach has been to provide a hinged breech block. In this design, the bolt is arranged in the breech block with an integral, internal bolt pin. When a breech pin is retracted, the breech block is permitted to swing open by rotating about its hinge axis, releasing the bolt pin from the pneumatic ram assembly via this swinging movement. While this approach provides a completely internal bolt assembly, it suffers because the breech block may become loose over time and may fail to align itself properly or have a sloppy feel during play. Dirt and other debris can also enter into the breech through gaps between the breech block and the gun body.

SUMMARY OF THE INVENTION

According to one embodiment, a bolt assembly for a pneumatic paintball gun that incorporates principles of the present invention preferably comprises a bolt, a bolt linkage attached to the bolt, and a bolt removal assembly. The bolt linkage (or pin) preferably remains entirely inside the gun housing during operation of the gun. The bolt removal assembly preferably includes a bolt removal sleeve and an actuator (such as a handle or knob). Using the bolt removal assembly, the bolt assembly can preferably be removed as a single unit from the rear of the gun housing for maintenance and cleaning of the gun and its components. The actuator is preferably used to rotate the bolt sleeve and bolt for removal from the gun. A back plate is also preferably included to conceal the internal components of the marker and to prevent sand or other debris from entering the paintball gun through the back of the marker.

A method for removing a bolt assembly from a paintball gun is also preferably provided. Specifically, a rearward end of the bolt assembly is preferably rotated about a center axis of the bolt to disengage a bolt linkage from a pneumatic actuator. The bolt assembly is then preferably withdrawn from the marker through a rearward opening in the gun housing.

A pneumatic firing assembly, according to other principles of this invention, can also easily be installed or removed from a paintball gun. The pneumatic firing assembly preferably comprises a piston rod, a firing valve having a stem (or valve pin) positioned on or within an end of the piston rod, a piston chamber, and a firing mass positioned on an opposite end of the piston rod. The firing mass is preferably weighted to provide sufficient mass to activate the firing valve. A groove is preferably arranged in the firing mass for engaging a bolt linkage.

An electro-pneumatic paintball gun can be configured to utilize the above-described bolt assembly and pneumatic firing assembly. The paintball gun preferably includes a housing with a firing assembly chamber that receives the firing assembly and a bolt assembly chamber that receives the bolt assembly. A firing mass of the firing assembly is preferably arranged on a pneumatic piston. The firing mass preferably has a receiving groove for engaging a bolt linkage. A groove is preferably arranged in the housing between the firing assembly chamber and the bolt assembly to permit the bolt linkage to travel forwards and backwards with the pneumatic piston and firing mass. The electro-pneumatic paintball gun also preferably includes an opening in the rear of the housing that enables the firing assembly and bolt assembly to be readily removed from the paintball gun. A removable back plate can be provided to conceal the rear opening and prevent dirt or debris from entering the opening.

BRIEF DESCRIPTION OF THE DRAWINGS

The foregoing and other objects, features and advantages of the present invention will become more readily apparent from the following detailed description of various preferred embodiments, proceeding with reference to the accompanying drawings, in which.

DETAILED DESCRIPTION OF PREFERRED EMBODIMENTS

Figure 1:
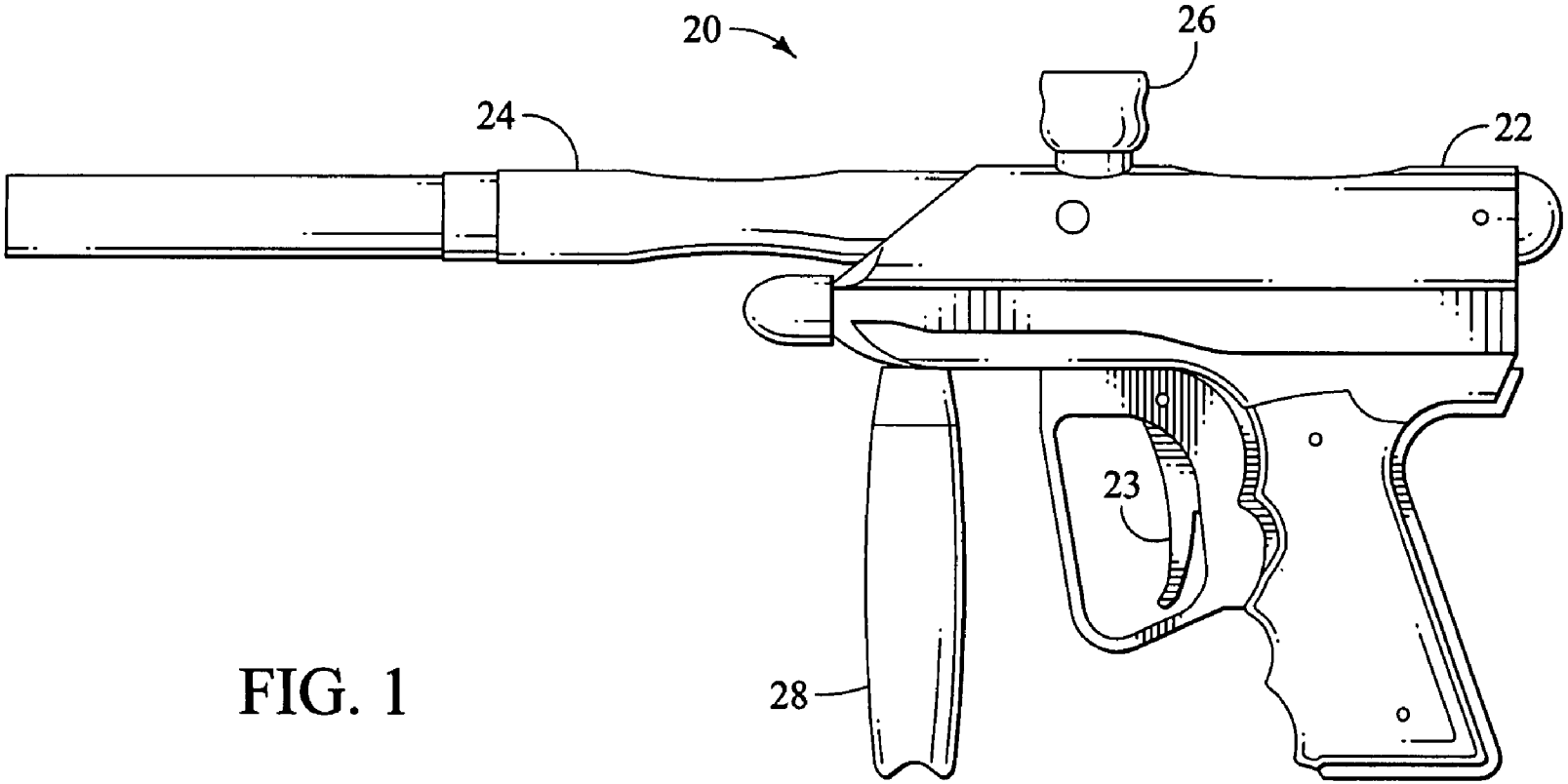
FIG. 1 is a side elevation view of an electro-pneumatic paintball gun according to a preferred embodiment of the invention.

Various aspects and embodiments of the present invention will now be described in greater detail with reference to the accompany drawings. Beginning with FIG. 1, an electro-pneumatic paintball gun 20 according to one embodiment of the present invention includes a body 22. The gun 20 is preferably configured to receive pressurized gas from a pressurized gas source (such as a compressed gas tank) through a pressure regulator 28. As can be seen from FIG. 1, other than the trigger 23, there are no external moving parts in this embodiment of the invention. In addition, with the exception of the barrel 24 and feed tube 26, there are no open areas of the body 22 exposed to contamination and damage from dirt or other debris. In particular, a back plate 340 (see FIG. 2A) is preferably provided to removably cover a rearward opening in the paintball gun 20.

Figure 2A:
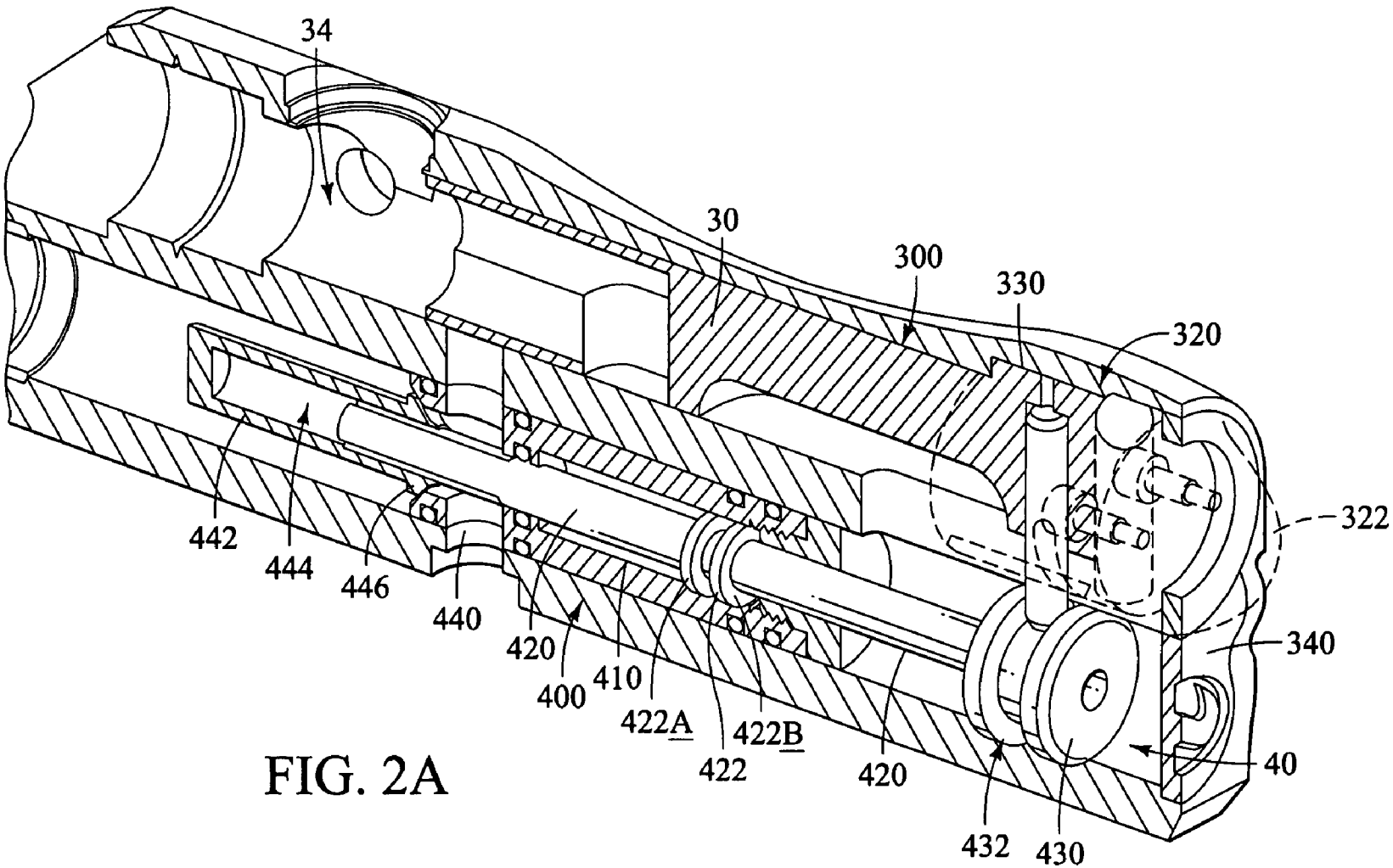
FIG. 2A is a vertically cross-sectioned perspective view illustrating one embodiment of the electro-pneumatic paintball gun of FIG. 1.

FIG. 2A is a vertically cross-sectioned perspective view of a first embodiment of the electro-pneumatic paintball gun 20 of FIG. 1, showing the internal gun components. Referring to FIG. 2A, the internal components of the electro-pneumatic paintball gun 20 of FIG. 1 preferably include a bolt assembly 300 disposed within an upper, bolt assembly chamber 30 and a firing assembly 400 disposed within a lower, firing assembly chamber 40.

The bolt assembly 300 preferably includes a bolt 310, a bolt linkage (or pin) 312, and a bolt removal sleeve 320. The bolt linkage 312 is preferably attached to a rearward portion of the bolt 310. When arranged in the gun body, the bolt linkage 312 preferably extends downward through a housing channel 32 arranged between the bolt assembly chamber 30 and the firing assembly chamber 40 to communicate with a firing mass 430 of the firing assembly 400. In this embodiment, for example, the bolt linkage 312 is received into a groove 432 of the firing mass 430.

The firing assembly 400 preferably includes a pneumatic cylinder 410 that houses a pneumatic piston 422 arranged on a piston rod 420. The firing mass 430 is preferably arranged on a rearward end of the piston rod 420. The firing mass 430 can be threaded onto the piston rod 420, formed integrally with the piston rod 420, or attached the piston rod 420 in any other method desirable. The firing mass 430 preferably includes a groove 432 configured to receive an end of the bolt linkage 312 from the bolt assembly 300. In this embodiment, a forward end of the piston rod 420 extends through a valve body 440 and into a mating hole 444 in the valve pin 442.

In operation, compressed gas is delivered to alternating sides of the pneumatic piston 422 on the piston rod 420 to operate the marker. In a loading operation, compressed gas is delivered to a front end 422A of the piston 422 and vented from a back end 422B of the piston 422 causing the piston rod 420 to move to a rearward position in the cylinder 410. The firing mass 430 and connected bolt 310 are thereby moved to a rearward position in the paintball gun 20, and a paintball is permitted to enter the breech 34 through the feed tube 26.

When a firing sequence is initiated, compressed gas is directed to a rearward end 422B of the piston 420 through the solenoid valve 50 and is vented from the front end 422A of the piston 422. The piston rod 420 thereby moves forward in the cylinder, causing the firing mass 430 and attached bolt linkage 412 and bolt 410 to move forward in the paintball gun 20. As the piston rod 420 and attached bolt 412 reach their forward positions, the paintball is loaded into its firing position and the piston rod 420 contacts a forward wall in the firing valve pin 442, opening the firing valve 440 and causing compressed gas to be released from the compressed gas storage chamber 42 through the bolt 310 and into contact with the paintball to expel it from the marker 20.

Figure 2B:
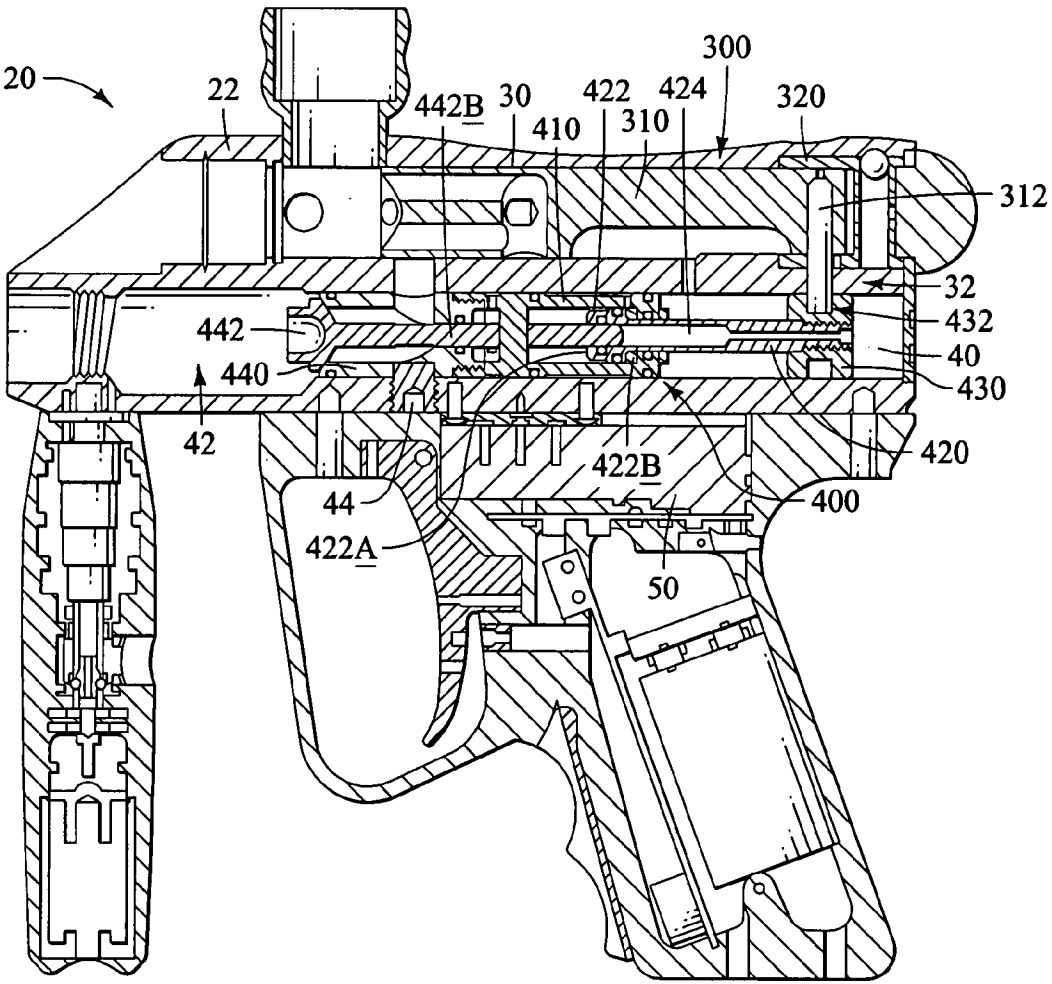
FIG. 2B is a vertically cross-sectioned side elevation view of an alternative embodiment of the electro-pneumatic paintball gun of FIG. 1.

FIG. 2B illustrates an alternative embodiment of the electro-pneumatic paintball gun 20 of FIG. 1. Referring to FIG. 2B, in this alternative embodiment, the firing valve pin 442B is arranged with its stem extending into a receiving chamber 424 in the piston rod 420. The receiving chamber 424 is preferably vented on an opposite end to prevent resistance to piston rod movement 420 resulting from the build-up of gas. In this embodiment, as the piston rod 420 is driven forward by the application of compressed gas to a rear 422B of the piston 422, the piston rod 420 slides forward along the stem of the valve pin 442B until a rear wall of the receiving chamber 424 contacts the valve pin 442B. The momentum imparted by the firing mass 430 causes the valve pin 442B to unseat from the valve body 440, thereby releasing compressed gas from the compressed gas storage area 42 into the forwardly situated bolt 310 and out of the paintball gun 10.

Figure 3A:
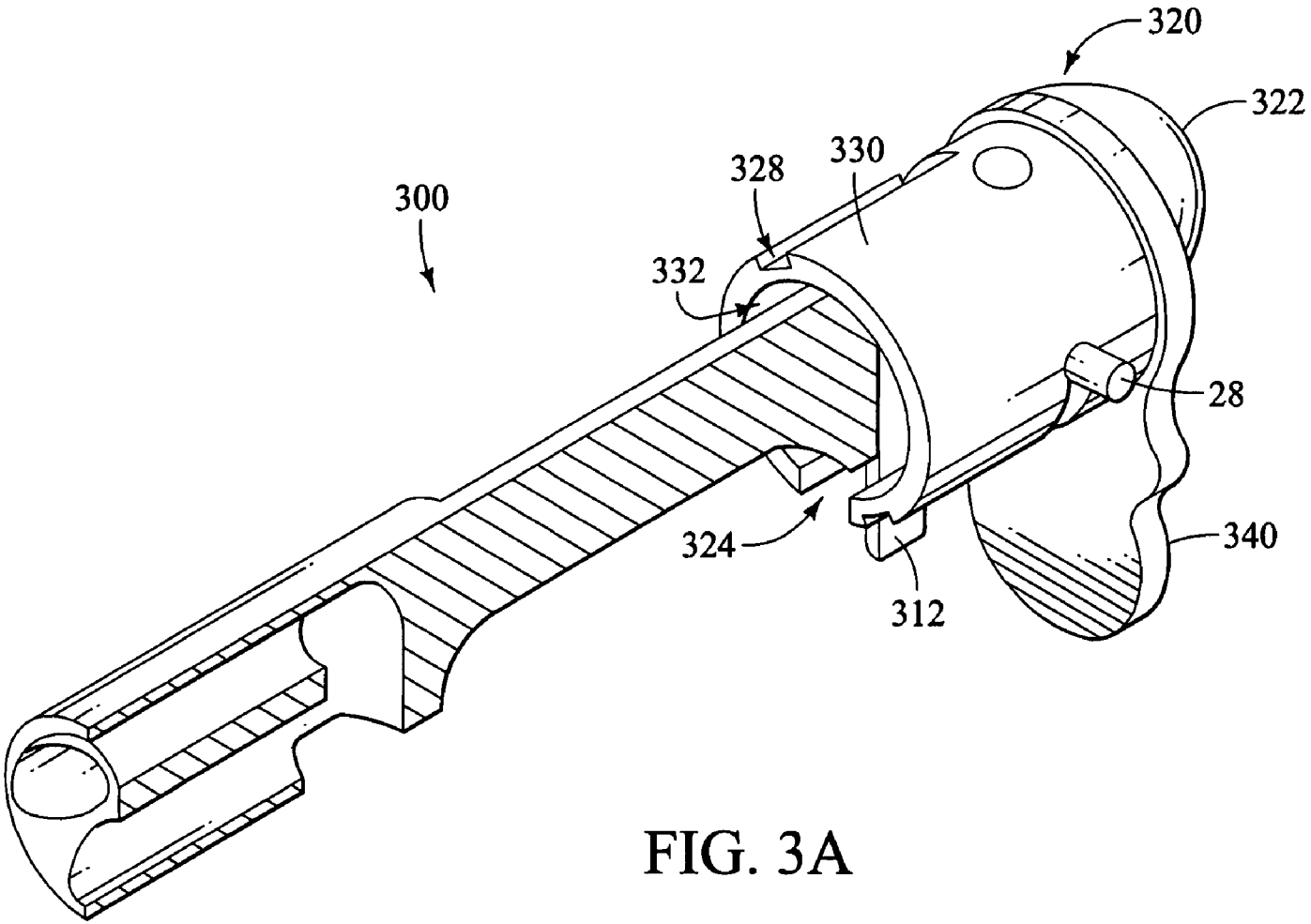
FIG. 3A is a perspective view of a paintball gun bolt assembly according to a preferred embodiment of the invention.
Figure 3B:
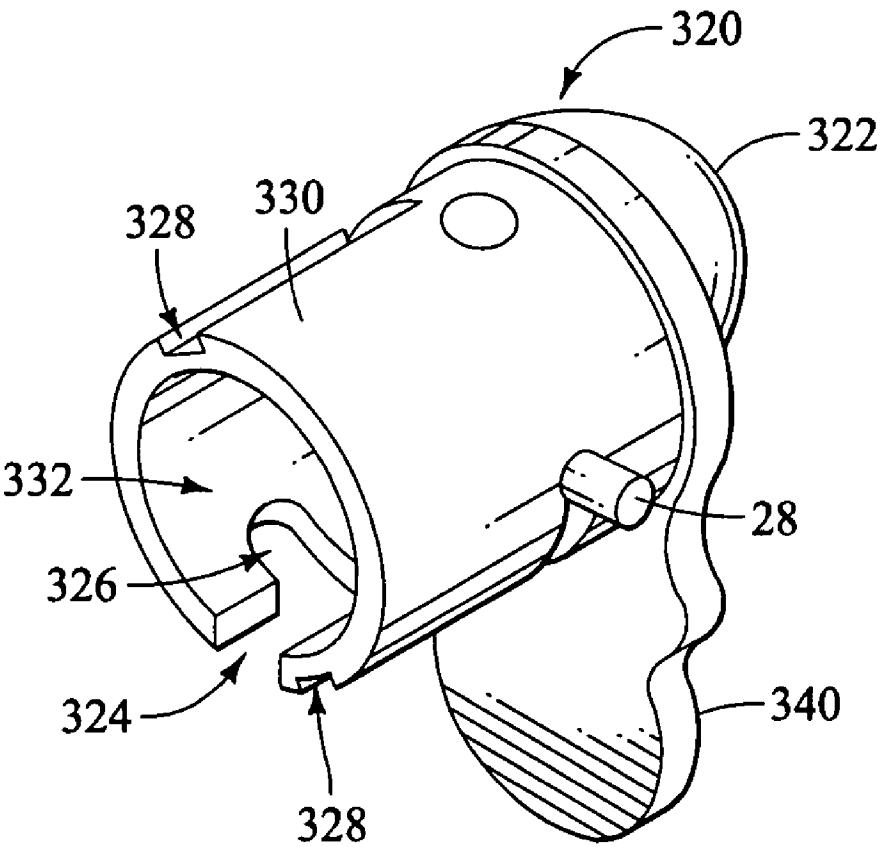
FIG. 3B is a perspective view of a bolt sleeve of the bolt assembly of FIG. 3A.

FIG. 3A provides a schematic perspective view of the bolt assembly 300. FIG. 3B provides a schematic perspective view of the bolt sleeve 320. Referring now to FIGS. 2A, 3A and 3B, the bolt assembly 300 can preferably be readily removed from the paintball gun 20 using a simple twist and pull action. More specifically, the bolt assembly 300 preferably includes a bolt sleeve 320 having an actuator 322 (such as a handle, knob, tab, twist cap, finger holes, gripping surface, or other actuating mechanism). The bolt sleeve 320 is configured to be disposed around a rearward portion of the bolt 310 when the bolt 310 is in its rearward position. The bolt sleeve 320 preferably comprises a bolt linkage groove 324 that permits the bolt linkage 312 to slide freely forward and back during operation of the paintball marker while the bolt assembly 300 is positioned in the marker 20. The bolt sleeve 320 also preferably includes a bolt catch groove 326 that engages the bolt linkage 312 to permit removal of the bolt assembly 300 from the marker 20.

More specifically, the bolt sleeve 320 preferably comprises a cylindrical housing 330 having a receiving chamber 332 that fits around an external circumference of the bolt 310. A bolt linkage groove 324 is preferably longitudinally arranged along the center of the bottom of the bolt sleeve 320 and extends from a forward end of the bolt sleeve 320 a predetermined distance toward the rearward end of the bolt sleeve 320. The bolt linkage groove 324 is preferably sized wide enough and long enough so as not to restrict movement of the bolt linkage 312 during operation of the marker 20. The bolt catch groove 326 preferably extends perpendicular to the bolt linkage groove 324 from a rearward end of the bolt linkage groove 324, such that twisting the bolt sleeve 320 (via the actuator 322) will engage the bolt linkage 312 in the catch groove 326 when the linkage 312 is in its rearward position.

To remove the bolt assembly 300 from the marker 20, with the bolt 310 in its rearward position, the actuator 322 is twisted so that the bolt linkage 312 is engaged in the bolt catch groove 326. The actuator 322 is twisted further until the bolt linkage 312 contacts the end of the bolt catch groove 326. The bolt linkage 312 is then moved out of the groove 432 in the firing mass 430. The housing channel 32 is preferably wide enough to permit the bolt linkage 312 to swing clear of the firing mass 430. The bolt assembly 300 can then be removed through an opening in the rear of the gun body 22, along with the back plate 340.

Guide grooves 328 are also preferably provided in the bolt sleeve 320 to align with and engage guide pins 28 arranged in the gun body 22. The guide grooves 328 and pins 28 provide a travel path for the bolt sleeve 320 to ensure that the bolt removal sleeve 320 is aligned properly during removal and reinsertion. A mating notch and detent (or other locking mechanism) can also be provided within the bolt sleeve 320 to retain the bolt linkage 312 in the bolt catch groove 326 while the bolt assembly 300 is removed from the gun body 22. Upon reinsertion into the gun body 22, the twisting action of the actuator 322 to realign the bolt linkage 312 within the firing mass groove 430 releases the detent from the notch (or otherwise unlocks the locking mechanism) and permits the bolt linkage 312 to travel from the catch groove 326 back into the bolt linkage groove 324.

In an alternative embodiment, the actuator could be attached directly to the bolt. The actuator in this embodiment would move with the bolt and would be accessible through a rearward opening in the paintball gun when the bolt is in its rearward position. As in the previous embodiment, twisting the actuator would cause the bolt linkage to disengage from the firing mass. The bolt assembly could then be removed through the back of the marker. Guide channels could be provided in the bolt, rather than the bolt sleeve, to align with guide pins in the paintball gun body to ensure proper alignment of the bolt in the bolt chamber of the paintball gun.

Figure 4:
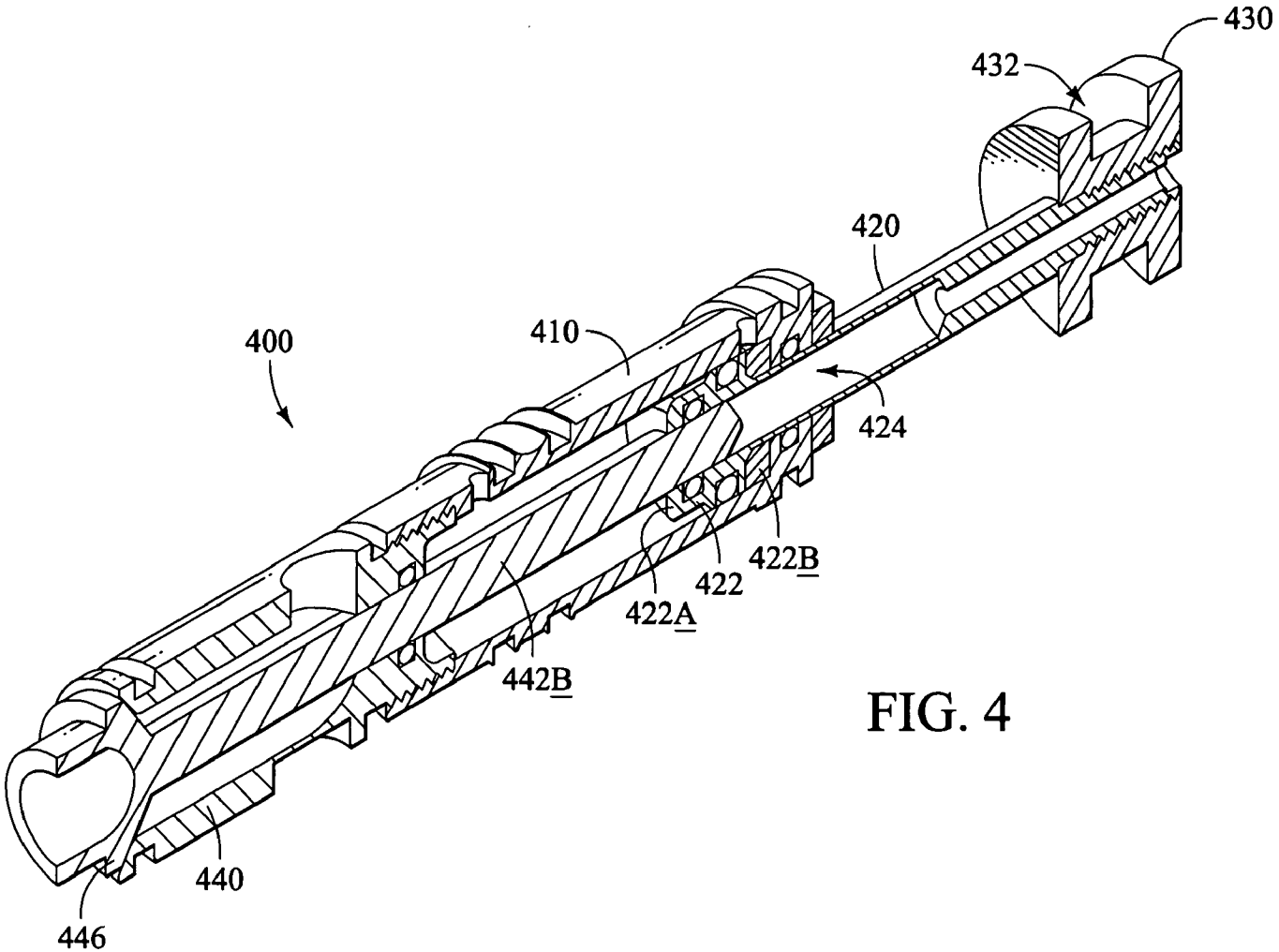
FIG. 4 is a vertically cross-sectioned perspective view of the firing assembly of the electro-pneumatic paintball gun of FIG. 2B.

FIG. 4 is a schematic cross-sectional side view of the firing assembly 400 of the embodiment of FIG. 2B. Referring now to FIGS. 2B and 4, a firing assembly 400 according to one embodiment of the present invention includes a pneumatic cylinder 410 housing a piston 422 arranged on a piston rod 420. The pneumatic cylinder 410 includes ports near both ends to direct or vent compressed gas to or from opposite sides of the piston 422. An end of the piston rod 420 extending from a rearward end of the cylinder 410 carries the firing mass 430. An opposite end of the piston rod 420 receives one end of a firing valve pin 442B in an internal chamber 424. The firing valve pin 442B extends through a firing valve body 440. A valve head 446 on the opposite end of the firing valve pin 442B resides within a compressed gas storage chamber 42 and is biased in a sealed (closed) position (for example, by pneumatic or spring force). The piston rod 420 preferably comprises a venting port 424 to vent the chamber 424 and prevent pneumatic resistance against the firing valve pin 442B.

The firing assembly 400 is preferably operated by using a solenoid valve 50 to direct compressed gas to one side of the pneumatic piston 422 while venting the opposite side. When compressed gas is supplied to a front end 422A and vented from a back end 422B of the piston 422, the compressed gas storage chamber 42 is permitted to charge with compressed gas. To fire the marker, compressed gas is supplied to the rearward end 422B and vented from the forward end 422A of the pneumatic piston 422. The pneumatic piston rod 420 is thereby driven forward until the rearward wall of the chamber strikes the firing valve pin 442B. The momentum given to the piston rod 422 by the firing mass 430 causes the valve head 446 to unseat from the valve body 440, releasing the compressed gas from the compressed gas storage chamber 42 through the valve body 440.

In a preferred configuration, the firing assembly 400 can be removed as a unit together with all its components. Referring to FIGS. 2B and 4, a retaining screw 44 or other attachment mechanism (such as tab and detent mechanisms) retains the firing assembly 400 in proper position and orientation in the marker 10. To remove the firing assembly 400, the retaining screw 44 is removed or the attachment mechanism is otherwise released. The firing assembly 400 can then be removed through a rearward opening in the gun body 22.

Having described and illustrated the principles of the invention in a preferred embodiment thereof, it should be apparent that the invention can be modified in arrangement and detail without departing from such principles. We claim all modifications and variations coming within the spirit and scope of the following claims.

What is claimed is:

1. A pneumatic paintball gun, comprising:

a body comprising a rearward end;

an opening arranged in the rearward end of the body;

a bolt assembly chamber accessible through the opening in the rearward end of the body;

a separate chamber arranged adjacent the bolt assembly chamber;

a pneumatic piston rod arranged in the separate chamber;

a bolt assembly arranged in the bolt assembly chamber, said bolt assembly comprising a bolt and an internal bolt linkage that selectively connects with the pneumatic piston rod;

a bolt removal sleeve comprising a receptacle that surrounds a rearward end of the bolt, wherein said bolt removal sleeve selectively engages the bolt linkage to disengage the bolt linkage from communication with the pneumatic piston rod for removal of the bolt assembly from the paintball gun; and wherein the bolt removal sleeve further comprises a channel that permits forward and rearward movement of the bolt linkage within the channel independent of the bolt removal sleeve when operating the paintball gun.

2. A paintball gun according to claim 1, wherein the bolt removal sleeve rotates about a center axis of the bolt and selectively engages and disengages the bolt linkage through said rotation about the bolt axis.

3. A paintball gun according to claim 1, wherein the bolt removal sleeve further comprises guide channels arranged along an external surface of the bolt removal sleeve, wherein the body further comprises guide pins arranged on the internal surface of the bolt assembly chamber, and wherein the guide channels mate with the guide pins to ensure proper alignment of the bolt sleeve during insertion and removal and rotational movement of the bolt removal sleeve with respect to the paintball gun body.

4. A pneumatic paintball gun comprising:

a body comprising a bolt assembly chamber and a firing assembly chamber accessible through one or more openings in a rearward end of the body;

a firing assembly comprising a pneumatic piston rod arranged in the firing assembly chamber, said firing assembly further comprising a pneumatic cylinder for controlling movement of the pneumatic piston rod;

a firing mass arranged on a rearward end of the pneumatic piston rod;

a pneumatic piston arranged on a separate portion of the pneumatic piston rod from the firing mass; and a bolt assembly arranged in the bolt assembly chamber, said bolt assembly comprising a linkage that selectively physically engages the firing mass at the rearward end of the pneumatic piston rod.

5. A paintball gun according to claim 4, further comprising a groove in the firing mass arranged on the rearward end of the pneumatic piston, wherein the bolt linkage is selectively arranged within the groove.

6. A paintball gun according to claim 4, further comprising a firing valve having a valve actuator mating within a receptacle formed in a forward end of the pneumatic piston rod.

7. A paintball gun according to claim 4, further comprising a solenoid valve that controls operation of the pneumatic piston.

8. A pneumatic paintball gun, comprising:

a body comprising a rearward end having an opening;

a bolt assembly chamber accessible through the opening in the rearward end of the body;

a separate chamber formed in the body adjacent to the bolt assembly chamber;

a pneumatic piston rod arranged in the separate chamber;

a bolt assembly arranged in the bolt assembly chamber, said bolt assembly comprising a bolt linkage configured to communicate with the pneumatic piston rod; and a bolt removal sleeve removal coupled to the body within the opening in the rearward end of the body, said bolt removal sleeve configured to selectively disengage the bolt linkage from communication with the pneumatic piston rod; and wherein the bolt removal sleeve further comprises a channel that permits uninterrupted forward and rearward movement of the bolt linkage within the channel when the bolt assembly is arranged in an operating position within the paintball gun.

9. A paintball gun according to claim 8, wherein the bolt removal sleeve further comprises an actuator to permit finger-gripping by a user of the paintball gun.

10. A paintball gun according to claim 8, wherein the bolt removal sleeve further comprises a locking system that retains the bolt and bolt linkage in communication with the bolt removal sleeve when removed from the paintball guns but which disengages from the bolt and bolt linkage to permit forward and rearward movement of the bolt and bolt linkage with respect to the bolt removal sleeve when arranged in the paintball gun.

11. A paintball gun according to claim 8, further comprising a groove arranged in the pneumatic piston to receive the bolt linkage, wherein rotational movement of the bolt removal sleeve selectively disengages the bolt linkage by causing the bolt linkage to swing out of a groove.

12. A paintball gun according to claim 11, wherein the bolt removal sleeve further comprises a catch groove that selectively engages the bolt linkage when the bolt removal sleeve is rotated from a first position to a second position to enable removal of the bolt assembly from the paintball gun.

13. A paintball gun according to claim 8, wherein the bolt removal sleeve further comprises a guide channel arranged on the external surface of the bolt removal sleeve that mates with a guide pin in the gun body to guide insertion and removal of the bolt removal sleeve with respect to the paintball gun body.

14. A pneumatic paintball gun, comprising:

a body comprising a bolt assembly chamber and a firing assembly chamber;

a pneumatic piston rod arranged in the firing assembly chamber, said pneumatic piston rod comprising forward end and a rearward end;

a firing mass arranged on a the rearward end of a the pneumatic piston rod;

a pneumatic piston arranged on a separate portion of the pneumatic piston rod than the firing mass; and a bolt assembly arranged in the bolt assembly chamber, said bolt assembly comprising a bolt linkage coupled to the firing mass at the rearward end of the pneumatic piston rod for movement therewith.

15. A paintball gun according to claim 14, further comprising a firing valve having a valve actuator, wherein the valve actuator mates with a forward end of the pneumatic piston rod.

16. A paintball gun according to claim 15, wherein the piston rod comprises a receptacle, wherein the valve actuator comprises a pin, and wherein the receptacle of the piston rod receives the valve actuator pin.

17. A paintball gun according to claim 16, wherein the piston rod comprises a vent configured to vent compressed gas from the piston rod receptacle.

* * * * *

UNITED STATES PATENT AND TRADEMARK OFFICE

CERTIFICATE OF CORRECTION

PATENT NO. : 7,237,544 B2
APPLICATION NO. : 10/753215
DATED : July 3, 2007
INVENTOR(S) : Danial S. Jones It is certified that error appears in the above-identified patent and that said Letters Patent is hereby corrected as shown below:

At Col. 7 line 5, please replace “removal” with --removably--.
At Col. 7 line 21, please replace “guns” with --gun--.
At Col. 8 line 14, please replace “a the” with --the--.

Signed and Sealed this

Thirteenth Day of November, 2007

JON W. DUDAS
*Director of the United States Patent and Trademark Office*